United States Patent [19]

Lewinger

[11] 4,201,228

[45] May 6, 1980

[54] NON-TOBACCO CONTAINING SMOKING PRODUCT

[76] Inventor: Olga Lewinger, 11 Niles Pl., Staten Island, N.Y. 10314

[21] Appl. No.: 805,989

[22] Filed: Jun. 13, 1977

[51] Int. Cl.[2] ..... A24D 1/18; A24C 5/00

[52] U.S. Cl. ..... 131/2; 131/20 R

[58] Field of Search ..... 131/20 R, 2, 15 C, 17 R, 131/140 L, 144

[56] References Cited

U.S. PATENT DOCUMENTS

| | | | |
|---|---|---|---|
| 92,427 | 7/1869 | Consuegra et al. | 131/15 C |
| 2,930,720 | 3/1960 | Finberg | 131/2 |
| 3,034,931 | 5/1962 | Keifer | 131/2 |
| 3,100,492 | 8/1963 | Schmidt | 131/2 |

*Primary Examiner*—Vincent Millen

*Attorney, Agent, or Firm*—Myron B. Kurtzman

[57] ABSTRACT

A process for preparing and the ingredients for preparing a non-tobacco smoking product is disclosed. The product consists essentially of a mixture comprising sugar beet leaves, white beet leaves, sugar cane leaves and the inner white part of the grapefruit peel.

6 Claims, No Drawings

NON-TOBACCO CONTAINING SMOKING PRODUCT

BACKGROUND OF THE INVENTION

This invention relates to a non-tobacco containing smoking product. More particularly, this invention relates to the discovery of a non-tabacco containing smoking product having the taste, aroma, flavor and burning characteristics similar to tobacco but free of the harmful effects of tabacco.

In recent years medical studies and statistical studies have shown that tobacco may be harmful to ones health. It has been proposed that tobacco may, for example, have harmful effects upon the cardio-vascular system and the respiratory system. Nevertheless, the number of individuals smoking tabacco products has been increasing, with statistical studies showing that the increase is associated with young people.

It has been proposed to find a substitute for tobacco which will be free of the harmful effects associated with tobacco and particularly with nicotine and tars which are inhaled into the lungs when smoking tobacco. The substitute would have to look like, taste like, have the aroma and flavor of tobacco in order to satisfy the psychological needs which may be associated with tobacco smoking.

In U.S. Pat. No. 2,930,719 of Finberg, issued Mar. 29, 1960 there is disclosed a wide variety of nicotine free products which are suggested for use in a tobacco-free smoking product including ingredients containing niacin and rutin. It is suggested that the smoking composition will not have a vascular-constricting effect. The disclosure does not, however, disclose specifically a composition which is substantially identical to the taste, aroma and flavor of tabacco containing smoking products.

U.S. Pat. No. 3,369,352 and U.S. Pat. No. 3,369,551 both of Carroll and each issued Feb. 20, 1968 disclose a process for preparing a smoking product and a smoking product which is a water and organic solvent extracted porous residuum of the leafy portion of a plant selected from the group consisting of lettuce, cabbage, broccoli, collard, kohlrabi, spinanch and papaya plus added sweeteners, vitamins and other ingredients. The method of preparing is not simple in that there are several steps and the combination of ingredients is complicated by its number making it difficult to produce the flavor most appealing to smokers.

U.S. Pat. No. 3,034,931 of Kiefer discloses a substitute tobacco product made from sagebrush. In order to obtain a desirable flavor it is suggested that one should add paprika and tumeric.

U.S. Pat. No. 3,702,615 of Rozacky et al issued Nov. 14, 1972 discloses a non-tobacco smoking, chewing and dipping product of leaves of lettuce, spinach or cabbage. The process of producing the product involves multiple soaking and pressing steps, drying steps and requires the addition of additives in order to obtain the simulated tobacco taste and appearance.

U.S. Pat. No. 3,703,177 of Hind, issued Nov. 21, 1972 discloses a smoking product that is made from waste beet pulp which may be used alone or may be blended with tobacco. This product requires complicated cooking and refining steps and is generally not satisfactory to the smoker without the addition of additives such as tobacco itself.

Other patents disclosing tobacco substitutes or methods of modifying tobacco are: U.S. Pat. No. 3,112,754 issued Dec. 3, 1963; U.S. Pat. No. 3,106,209 of Torigian, issued Oct. 8, 1963; U.S. Pat. No. 3,575,177 of Briskin, issued Apr. 20, 1971 and U.S. Pat. Nos. 3,638,660, 3,705,589, 3,491,766, 2,943,958, 2,943,959, 2,907,686, 3,738,374, 3,100,492, 3,255,760, 3,545,448, 3,434,171, 3,323,524 and 3,720,660.

It is highly desirable to obtain a simple combination of ingredients, requiring little processing and chemical treatment having the flavor, aroma, taste and smoking characteristics of tobacco without the addition of additives which combination of ingredients is free from the harmful effects of tobacco but at the same time satisfies the desires of the tabacco smoker.

SUMMARY OF THE INVENTION

In accordance with this invention there is provided a non-tabacco smoking product and the method of producing the product. The smoking product is free of nicotine and tobacco tars and hence does not produce the harmful side effects which can be associated with tobacco products. Nevertheless, the smoking product of this invention satisfies the smoking needs of the typical smoker in that the product of this invention looks, tastes, smells and has the flavor of cigarette tobacco and has the smoking characteristics of tobacco, i.e. slow burning.

The invention comprises a combination of sugar beet leaves, white beet leaves, sugar cane leaves and the inner white part of the grapefruit peel. The leaves are air dried, shredded to the desired size and rolled in tobacco paper.

It is a general object of the invention to provide a non-tabacco smoking product comprised of sugar beet leaves, white beet leaves, sugar cane leaves and the inner white part of the grapefruit peel.

Another object of the invention is to produce a smokable product that will have the physical characteristics of natural tobacco and yet eliminate the harmful effects associated with tabacco.

Still another object is that the mixture of sugar beet leaves, white beet leaves, sugar cane leaves and the inner white part of the grapefruit peel will resemble natural tobacco to a great degree in its flavor and aroma.

An additional object is the burning qualities of the above mentioned mixture. The mixture burns evenly and smoothly and provides a uniform white ash.

A specific object of the invention is to produce a non-tabacco smoking product that is relatively inexpensive and is practicable on a commercial scale and economically feasible.

Another object of the invention is the quick and easy processing procedure.

DETAILED DESCRIPTION OF PREFERRED EMBODIMENTS

The non-tobacco product of this invention comprises a combination of about 55% sugar beet leaves, 25% white beet leaves, 10% sugar cane leaves and 10% of the inner white part of the grapefruit peel. All percentages herein are percentages by weight.

The fresh leaves and grapefruit peel are set out to air dry. The air drying process can be out in the open under the sun or within barns. In accordance with this invention the leaves and peel need only be air dried for from about 3 days to about 5 days and preferably 3 or 4 days.

After the air drying or curing process is complete the ingredients are shredded to the desired size thoroughly mixed and rolled into tabacco paper so as to provide a non-tabacco smoking cigarette. Although as described, the shredding is performed after air drying, one can shred the leaves first and air dry afterward. However, this is not as desirable as air drying the unshredded leaves and peel since it is simpler to have the entire leaf and/or peel exposed at all times to the air.

The air drying period can be extended to periods of times longer than 4 or 5 days when necessary because of excess humidity and the like or where desired it can be air dried for longer periods of time in order to achieve different characteristics for the smoking product, however, to achieve the high quality product of this invention which is extremely close to natural tobacco in its smoking characteristics it is generally desirable to limit the drying period to between 3 and 5 days and preferably 3 or 4 days.

EXAMPLE I

Fresh leaves of sugar beets, white beets and sugar cane and a grapefruit were obtained from a commercial source.

The fruit and juice from the grapefruit were removed and the inner white part of the peel was carved out in thin slices so as to facilitate the drying process. The leaves and peel were hung in a manner such that substantially all the surface of the material were exposed to the air. The material was left to air dry for 3.5 days.

Upon drying the leaves and peel were shredded to the size of cigarette tobacco and completely mixed in a slowly rotating blendor so as to obtain a complete mix of the ingredients. The mix was compacted and rolled into tabacco paper.

The smoking characteristics, flavor, aroma and taste was substantially indistinguishable from cigarettes of smoking tobacco.

Although the invention has been described in terms for the preparation of a non-tobacco cigarette, the composition of this invention can be employed for the preparation of chewing tobacco, pipe tobacco or as a substitute for cigar tobacco.

When so desired, the tobacco substitute of this invention can be modified by additives such as those which produce a menthol taste.

The invention claimed is:

1. A non-tobacco containing smoking product produced by the process consisting of:

a. air drying for a period of from about 3 days to about 5 days sugar beet leaves, white beet leaves, sugar cane leaves and the inner white part of grapefruit peel;

b. shredding and chopping the air dried sugar beet leaves, white beet leaves, sugar cane leaves and the inner part of the grapefruit peel into fine particles;

c. thoroughly mixing the dried chopped and shredded leaves in a proportion of about 55% sugar beet leaves, 25% white beet leaves, 10% sugar cane leaves and 10% inner white part of the grapefruit peel;

d. rolling the mixed ingredients in tobacco paper.

2. A tobacco substitute, smoking product having the characteristics similar to tobacco containing cigarette products but without containing nicotine, the product consisting of 55% sugar beet leaves, 25% white beet leaves, 10% sugar cane leaves and 10% of the white inner part of the grapefruit peel.

3. The product of claim 1 wherein the material is air dried for a period of about 3 to about 4 days.

4. The product of claim 1 in sheet form.

5. The product of claim 1 further containing menthol.

6. A process for preparing a tobacco substitute product consisting of:

a. air drying for a period of 3 days to about 5 days the ingredients consisting of sugar beet leaves, white beet leaves, sugar cane leaves and the inner white part of grapefruit peel;

b. shredding and chopping the ingredients to a consistency suitable for rolling in tobacco paper;

c. thoroughly mixing the ingredients in a proportion of about 55% sugar beet leaves, 25% white beet leaves, 10% sugar cane leaves and 10% inner white part of the grapefruit peel; and d. rolling the mixed ingredients into tabacco paper thereby forming a non-tabacco containing smoking product.

* * * * *